United States Patent [19]

Segoshi et al.

[11] 3,988,108

[45] Oct. 26, 1976

[54] PROCESS FOR COLORING FIBROUS STRUCTURES

[75] Inventors: Kenji Segoshi; Toshio Kidogami, both of Osaka; Chinzo Yamaba, Hirakata, all of Japan

[73] Assignee: Kanebo, Ltd., Tokyo, Japan

[22] Filed: Apr. 9, 1974

[21] Appl. No.: 459,444

[30] Foreign Application Priority Data

Apr. 9, 1973 Japan ..... 48-40198

[52] U.S. Cl. ..... 8/18 R; 8/17; 8/21 C; 8/183

[51] Int. Cl.[2] ..... D06P 5/02

[58] Field of Search ..... 8/18, 21 C, 183, 17

[56] References Cited

UNITED STATES PATENTS

| | | | |
|---|---|---|---|
| 2,043,069 | 6/1936 | Rüsch et al. | 8/34 |
| 2,373,191 | 4/1945 | Landolt | 8/18 |
| 2,722,489 | 11/1955 | Hennessey et al. | 8/18 |
| 2,762,719 | 9/1956 | Kleiner et al. | 8/18 |
| 3,011,860 | 12/1961 | Hirshfeld et al. | 8/177 R |
| 3,099,635 | 7/1963 | Wagner et al. | 8/18 |
| 3,110,551 | 11/1963 | Fletcher et al. | 8/18 |
| 3,198,595 | 8/1965 | Mawson et al. | 8/18 |
| 3,232,691 | 2/1966 | Wilhelm et al. | 8/18 |
| 3,458,986 | 8/1969 | Allison et al. | 8/21 C |
| 3,679,348 | 7/1972 | Asahi et al. | 8/18 |
| 3,873,265 | 3/1975 | Kleber et al. | 8/21 C |

*Primary Examiner*—Ronald W. Griffin

*Attorney, Agent, or Firm*—Sughrue, Rothwell, Mion, Zinn and Macpeak

[57] ABSTRACT

A process for coloring a fibrous structure which comprises applying a coloring agent and a prepolymer or precondensate of a synthetic resin to a fibrous structure, heat-treating the fibrous structure, and then treating the fibrous structure with a reducing agent.

19 Claims, No Drawings

PROCESS FOR COLORING FIBROUS STRUCTURES

BACKGROUND OF THE INVENTION

1. Field of the Invention

This invention relates to a process for coloring fibrous structures, and, more specifically, to a process for coloring fibrous structures which provides colored fibrous structures with brilliant colors and superior fastness characteristics and also little contamination due to unfixed coloring agents in the uncolored portions, i.e., white background, and the colored portions.

2. Description of the Prior Art

When various fibers are colored by dyeing or printing, a small amount of the unexhausted or unfixed coloring agent is always present on the fibers. Such an unexhausted or unfixed coloring agent contaminates the colored portions or the uncolored portions of the fibers during soaping in the coloring process or during washing in use, and also dulls the color of the colored portions or reduces the brilliancy of the color and reduces the fastness of the colored fibers. Not only when a single dye is used for a single kind of fibers, but also when a plurality of dyes are used in order to obtain the desired color densities, the contamination of the fibers by the unfixed or unexhausted dyes is quite marked.

Nowadays, a great variety of fibers are used including natural fibers such as flax, cotton, silk or wool, semi-synthetic fibers such as viscose, acetate or triacetate fibers, and synthetic fibers such as polyvinyl alcohol, polyamide, polyester, polyacrylonitrile, or polypropylene fibers. These fibers differ from each other in chemical composition and properties, and a variety of dyes are used for coloring these fibers as shown in Table 1.

been to wash the dyeings repeatedly using various detergents, or perform the repeated washing after dyeing the fibers in a multiple of baths. In spite of these efforts, entirely satisfactory results have never been obtained.

In view of this, we have made extensive investigation in order to remove these defects, and finally have arrived at this invention. It is therefore an object of this invention to provide a commercially advantageous process for coloring fibrous structures whereby colored fibers free from contamination by unfixed dyes and having a brilliant color tones and superior fastness characteristics are obtained using simplified process steps.

SUMMARY OF THE INVENTION

This invention provides a process for coloring fibrous structures, which comprises applying a coloring agent and a prepolymer or precondensate of a synthetic resin to a fibrous structure, heat-treating the fibrous structure, and then treating the fibrous structure with a reducing agent. This process makes it possible to prevent contamination of the colored fibrous article by the unfixed dyes, and to provide colored fibrous structures having a brilliant color tone and superior fastness characteristics.

DETAILED DESCRIPTION OF THE INVENTION

In the present specification and appended claims, the term "fibrous structures" denote fibrous structures used for apparel, industrial and interior decorating purposes, such as yarns or threads, cables, ropes, nets, woven and knitted fabrics or nonwoven fabrics produced from one or more of natural fibers such as cotton, flax, wool or silk, semi-synthetic fibers such as viscose or acetate fibers, and synthetic fibers such as polyamide, polyvinyl alcohol, polyester, modacrylic,

TABLE 1

| | Kinds of Fibers | | | | | Kinds of Dyes | | | | | | |
|---|---|---|---|---|---|---|---|---|---|---|---|---|
| | Basic | Acid | Chrome | Metal-containing | Direct | Copper treated Direct | Vat | Naphthol and Its Derivatives | Soluble Vat | Disperse | Reactive | Pigment |
| Natural Fibers | | | | | | | | | | | | |
| Cotton | (0) | | 0 | | 0 | 0 | 0 | 0 | 0 | | 0 | 0 |
| Flax | | | 0 | | 0 | 0 | 0 | 0 | 0 | | 0 | 0 |
| Wool | (0) | 0 | 0 | 0 | 0 | | | | 0 | | 0 | (0) |
| Silk | (0) | 0 | 0 | 0 | 0 | | (0) | | (0) | | 0 | (0) |
| Semi-Synthetic Fibers | | | | | | | | | | | | |
| Viscose | | (0) | 0 | | 0 | 0 | 0 | 0 | 0 | | 0 | 0 |
| Acetate | (0) | 0 | | 0 | | | (0) | | | 0 | | (0) |
| Synthetic Fibers | | | | | | | | | | | | |
| Polyamide | | 0 | | 0 | 0 | | (0) | | | 0 | 0 | (0) |
| Polyvinyl Alcohol | | | | 0 | 0 | | 0 | 0 | | 0 | | (0) |
| Polyester | | | | | | | (0) | | 0 | 0 | | (0) |
| Modacrylic | 0 | 0 | | (0) | | | (0) | | | 0 | (0) | (0) |
| Acrylic | 0 | | | (0) | | | (0) | | | 0 | | (0) |
| Vinylidene Chloride | | | | | | | | | | 0 | | (0) |
| Vinyl Chloride | | 0 | 0 | 0 | | | | | | 0 | | (0) |
| Polyurea | | 0 | 0 | 0 | | | | | | 0 | | (0) |
| Polypropylene | | | 0 | 0 | | | | | | 0 | | (0) |
| Triacetate | | 0 | | 0 | | | | | (0) | 0 | | (0) |
| Polyurethane | | 0 | 0 | 0 | | | | | | 0 | (0) | (0) |

O : Usually used for dyeing and printing
(O) : Usable but partly limited

In order to utilize the physical and chemical properties of these fibers, these fibers are frequently used in a mix-spun or mix and interwoven or interknitted state. Thus, a mixture of various dyes appropriate to the constituent fibers is used to color such a fibrous structure, and therefore, in almost all cases, some dyes have no dyeability for certain kinds of fibers and contamination caused by such dyes is great. In an attempt to prevent such contamination, the previous practice has acrylic, polyvinylidene chloride, polyvinyl chloride, polyurea, polypropylene, triacetate or polyurethane fibers, using conventional techniques such as mix-spinning, interweaving or interknitting. Fibers containing a polar group such as a hydroxyl group (e.g., cotton, flax, regenerated cellulose, etc.) or an amino or imino group (e.g., wool, silk, polyamide, etc.), either alone or in admixture with each other or with other fibers, are especially preferred as the constituents of the fibrous structures which can be used in this invention. The preferred dyes used to color these fibrous structures are water-soluble dyes such as reactive, direct, acid, chrome or basic dyes, either alone or in admixture with each other or with water-insoluble dyes such as disperse or vat dyes. These dyes and other dyes which can be used in the present invention are well-known and can be appropriately selected from these described in Color Index for application thereof. The selection can be easily made by those skilled in the art.

A most critical feature of this invention is that the fibrous structure is heat-treated while a coloring agent and a prepolymer of a synthetic resin are present on the fibrous structure, and then the fibrous structure is treated with a reducing agent. It is well-known that reducing agents decolorize water-soluble dyes and colored fibers dyed with them by decomposing or solubilizing the dyes. We have however found that when these dyes are fixed to fibers in the copresence of a prepolymer of a synthetic resin, reducing agents do not effect such a change, and superior fastness characteristics and brilliancy can be obtained. This effect is produced only when the fibers, coloring agent and resin prepolymer are fixed integrally with each other. When a fibrous structure of fibers containing a polar group such as cotton, viscose fibers, wool or silk is dyed with a dye which is no compatible with these fibers, for example, a water-insoluble dye in the presence of the prepolymer described above, integral fixation cannot be attained, and the dye is decolorized and removed by the reducing agent. The above finding is quite unexpected from conventional knowldege and is a surprising finding in view of the prior art.

The present invention is based on the above findings and makes it possible to obtain a colored fibrous structure having superior fastness and brilliancy of the colored portions and little contamination of the white background, if any, with unfixed dyes when a fibrous structure composed of fibers of a single type is colored, using either dyeing or printing, with one or more different coloring agents. Furthermore, in light of the well-known fact that the above water-insoluble dyes are not affected by reducing agents when these dyes are fixed to fibers and, in contrast, the dyes which are not fixed to the fibers are decolorized by the reducing agents, colored articles with excellent color fastness and brilliancy and extremely low contamination of the white background can also be obtained in accordance with the present invention in the case where a fibrous structure composed of mix-spun fibers or interwoven or interknitted fabrics of cotton or flax, or a blend of an acetate fiber and silk is colored by either a dyeing method or a printing method.

Thus, the process of this invention comprises applying at least one coloring agent and a prepolymer or precondensate of a synethetic resin to the fibrous structure previously defined as above at the same time or in an obtional order in a single bath or separate baths, heat-treating the fibrous structure during or after the treatment with the coloring agents and the prepolymer or precondensate, and treating the thus heat-treated fibrous structure with a reducing agent to obtain a fibrous structure having brilliant colors, superior fastness characteristics and substantially no mutual contamination with unfixed coloring agents in the colored portions, and if an uncolored white backbground is present in the dyed fibrous structure, little contamination in the uncolored portions by the unfixed coloring agents.

The prepolymer of a synthetic resin can be applied in advance to the fibrous structure, or applied simultaneously with the coloring agent in the same bath, or applied after the application of the coloring agent. In any case, the same results are obtained so long as the heat-treatment of the fibrous structure is performed in the presence of both the coloring agent and the prepolymer. The effect of the subsequent reducing treatment is peculiar to the reducing agent. When this treatment is replaced by treatment with an oxidation agent, the effect is not obtained. Although some effect is observed with sodium perborate, hardly any effect is obtained with hydrogen peroxide and peracetic acid, and chlorides suffer from various disadvantages such as yellowing.

The prepolymer of a synthetic resin used in the present invention can be any of those resin compounds which have been used for resin finishing of cellulosic fibers. Examples of the prepolymer include formaldehyde-type precondensates or water-soluble formaldehyde polymers; prepolymers of thermosetting resins such as isocyanate-type resins, ethyleneimine derivative-type resins, nitrogen-free epoxy resins, acetal resins or ketone resins; and prepolymers of thermoplastic resins of the cross-linking vinyl, acrylic, ethylene or styrene types. Specific examples of the formaldehyde-type precondensates are precondensates of formaldehyde with such compounds as phenol, cresols, aromatic amines, urea, alkylene ureas, hydroxyalkylene ureas, thiourea, alkylene thioureas, hydroxyalkylene thioureas, dicyandiamides, dicyandiamidines, acid amides, carbamates, allophanes, aminotriazines, urones, ureidoes, ureines, imidazolidones, triazones, guanidines, hydantoins, or polyamides, and precondensates of formaldehyde with lower alkyl (e.g., having 1 to 4 carbon atoms) ethers of the above compounds. Examples of the water-soluble formaldehyde polymers are trioxane and tetraoxane. Of these prepolymers, hydroxyalkylene ureaformaldehyde precondensate aminotriazine-formaldehyde precondensates and water-soluble formaldehyde polymers give especially preferred effects.

Specific examples of formaldehyde-type precondensates are precondensates of monomethylolurea, dimethylolurea, trimethylolurea, hexamethylolmelamine, monomethylol ethylene urea, dimethylol ethylene urea, dihydroxymonomethylol ethylene urea, dihydroxydimethylol ethylene urea, dimethyloltriazone, dimethylolethyltriazone, monomethylolhydroxyethyltriazone, dimethylolhydroxyethyltriazone, dimethylolurone, trioxane, tetraoxane, etc. and formaldehyde. Most preferred examples thereof are hydroxy alkylene urea - formaldehyde precondensates such as dihydroxymono- or dimethylol ethylene urea, etc., triazone — formaldehyde precondensates such as dimethyloltriazone, dimethylolhydroxyethyltriazone, etc., and water-soluble formaldehyde polymers such as tetraoxane, etc.

When the formaldehyde-type precondensates described above are used conjointly with a latent acidic catalyst, far superior results can be obtained. Examples of suitable latent acidic catalysts include heavy metal salts such as zinc chloride or magnesium chloride, ammonium salts such as ammonium chloride, ammonium sulfate or ammonium nitrate, salts formed between organic amines and mineral acids such as ethanolamine hydrochloride, organic weak acids such as tartaric acid, lactic acid, acrylic acid or polyacrylic acid, ammonium salts of the organic weak acids, amine salts of the organic weak acids, and ammonium thiocyanate.

Specific examples of the water-insoluble dyes which can be used as coloring agent in this invention are (1) azo, azomethine, nitro, and anthraquinone disperse dyes which are insoluble or sparingly soluble in water and have the property of penetrating into the fibers in the form of an aqueous dispersion which is nearly colloidal, and (2) indigo, thioindigo, indigoid anthraquinone derivatives, and antraquinonic vat dyes composed of fused polycyclic quinones. The dyes (1) are widely used for dyeing polyester and polyamide synthetic fibers, and the dyes (2) are used for dyeing cellulosic fibers such as cotton or rayon, and natural fibers such as silk, or wool.

Examples of the water-soluble dyes are reactive dyes for cotton and wool having in the dye molecule an active group capable of forming a covalent bond by reaction with the fibers during dyeing, such as a dichlorotriazinyl group, a chlorotriazinyl group, a trichloropyrimidinyl group or a vinyl sulfone group; water-soluble direct dyes for dyeing cellulosic fibers such as cotton or rayon without mordanting, such as polyazo dyes (e.g., diazo or trisazo dyes) containing a sulfone group; water-soluble acid dyes for directly dyeing proteinous fibers such as wool or silk, which contain an acidic group such as a sulfonic or carboxyl group in the molecule; and basic dyes suitable for dyeing silk and containing in the molecule an amino group or its salt for chrome mordanting.

Briefly, the coloring agent and the prepolymer of a synthetic resin are applied to the fibrous structure in a medium such as a water using techniques such as immersion, spraying, coating or printing. A suitable amount of prepolymer which is applied to the fibrous structure is generally an amount of about 0.5 to 20% by weight, preferably 2 to 8% by weight, based on the weight of the fibrous structure. The preparation of solution containing the coloring agent and the prepolymer differs somewhat depending on whether they are simultaneously applied or separately applied, or according to the method of application or the method of coloring. The description will first be directed to the case of simultaneous application (in the case of a one-step one-bath method).

In this case, a solution of at least one of the abovedescribed dyes and prepolymers, and if desired, the latent acid catalyst is prepared. The method of preparation differs according to the method of applying such a coloring composition physically or chemically to give various colors. For example, such a solution is prepared as desired depending on the method of coloring such as dyeing or printing which can be a conventional printing procedure, for example, general machine printings such as screen printing, roller printing and the like, as well as spray printing, cover printing, color brushing, block printing, dyed style printing, stream printing and the like.

Thus, the coloring composition used in this invention optionally includes water for dissolving solids or viscous liquids; solvents such as alcohols, ethers, naphtha and the like for dissolving organic compounds such as dyes, aids, additives and the like, and solvents for use in solvent dyeing such as perchloroethylene or trichloroethylene. Also, the coloring composition used in the present invention can include various agents which are commonly used in conventional coloring compositions. Typical examples of such agents are a thickener or a migration-preventing agent such as wheat flour, a sugar powder, or a processed starch such as dextrin, a protein such as gelatin, bean milk or glue, a rubber such as gum arabic or Senegal rubber, a resin such as shellac or an alkyd resin, a sizing agent such as sidium alginate, etherified starch, carboxymethyl cellulose, or polyvinyl alcohol, etherified galactomannar or water/oil type or oil/water type emulsions, etc. If desired, the coloring composition can contain a wide variety of additives such as a weak oxidizing agent for preventing the discoloration of dyes, such as sodium meta-ntirobenzenesulfonate; various fiber treating agents such as a softening agent, a water-repelling agent or an antistatic agent; a pH adjusting agent such as sulfuric acid, phosphoric acid, acetic acid, urea, ammonia, triethanolamine or phosphates; a penetrant; a levelling agent; a fastness promoting agent; conventional dyeing or printing assistants for promoting or retarding dyeing, for example, an acid such as sulfuric acid, hydrochloric acid, formic acid, phosphoric acid, etc.; a salt such as sodium sulfate, sodium bisulfate, sodium chloride, sodium phosphate, sodium acetate, cream of tartar, ammonium thiocyanate, etc.; Turkey red oil, Monopol (trade name of a Turkey red oil, produced by Chemische Fabrik Stockhausen A.G.) and Igepon (trade name of a reaction product of an oleic acid salt and N-methyltaurine, produced by I. F. Farbenindustrie A.G.); and/or additives commonly used in the conventional dyeing or printing and various processings aids for textiles commonly used in conventional dyeing and printing.

The concentration of the coloring agent can be those appropriately determined according to the conventional printing or pad-dyeing liquors. The concentration of the prepolymer of a synthetic resin is about 0.7 to 30% by weight, preferably 5 to 20% by weight. The amount of the prepolymer is about 1 to 20 times, preferably 1.5 to 10 times, the weight of the coloring agent. If the amount of the prepolymer is smaller than the amount of the coloring agent, the decolorization or discoloration of the colored portions occurs in the subsequent step of treatment with a reducing agent. On the other hand, if it is larger than 20 times the weight of the coloring agent, incomplete removal and decolorization of the unfixed coloring agent results, and the colored fibers have a harsh feel. The pickup of the prepolymer, generally is about 60 to 120%, more generally about 70 to 100%, most generally 90 to 100% by weight to the weight of the fibers.

In addition to the above-described vat-dyeing or printing methods, the coloring composition can also be applied to the fibrous structure using coating methods such as doctor knife coating or roll coating or printing methods such as gravure printing or flexographic printing. The amounts of the coloring agent and the synthetic resin prepolymer applied to the fibrous structure can be determined appropriately according to concentrations of these components in the coloring composition liquor or the amount of the liquor to be applied. The length of time of contact of the fibrous structure with the dye can vary widely and is difficult if not impossible to define since as will be well recognized by one skilled in the art such time depends on various factors including the coloring characteristics of the dyes, the dyeability of the fibers, the degree of coloration desired, the method of dyeing employed, etc. Suffice it to say that such time can be varied widely and appropriate times selected by one of ordinary skill in the art based on conventional knowledge in the art taking into consideration the above factors. With respect to the length of time of contact with the prepolymer of the synthetic resin, it is sufficient if the fibrous structure is simply wet therewith.

The fibrous structure to which the coloring agent and the prepolymer have been applied can be pre-dried if desired. The pre-drying can be conducted at ambient temperatures or under appropriate heating. The heating temperaure can range up to 130° C but not sufficiently high to cause reaction of the prepolymer of the synthetic resin. The pre-drying is generally conducted at a temperature of about 60° to 120° C for about 1 to 10 minutes. The fibrous structure is then heat-treated.

Now, the description is directed to the application of the prepolymer first to the fibrous structure, and then the application of the coloring agent (two-stage two-bath method).

Those skilled in the art will easily recognize that the preparation of the solutions of the prepolymer and the coloring agent respectively are similar to the one-stage one-bath method described above. Briefly, a solution containing the prepolymer is prepared by dissolving in water a predetermined amount of the prepolymer and if desired, the catalyst described above. A suitable amount of the catalyst which can be used generally is about 2 to 30% by weight, preferably 5 to 12% by weight, based on the weight of the prepolymer of the synthetic resin. At this time, the solubility of the prepolymer can be enhanced by adding various kinds of solvents as described above. In this case of the two-stage two-bath method, the concentrations of the coloring agent and the prepolymer of the synthetic resin are same as those employed in the one-stage one-bath method described hereinbefore. If desired, additionally a penetrant such as various kinds of surface active agents for increasing the penetrability of the prepolymer, and also, as a tactile hand regulating agent, polyvinyl alcohol poly(sodium acrylate), sodium alginate, carboxymethyl cellulose, natural gums, polyalkylene glycols, and emulsified polyethylene, polyvinyl acetate or polyacrylic esters, etc. can be used. Furthermore, a pH adjusting agent, an antistatic agent, a water-repellent or oil-repellent, a softening agent, a salt, a whitening agent, or another coloring agent can also be incorporated.

The application of the solution of the prepolymer of synthetic resin can be performed using conventional impregnating methods such as padding, spraying, doctor knife coating or roll coating, and also printing methods such as roller printing or screen printing, and other printing methods such as gravure printing or flexographic printing. The amount of the prepolymer which must be applied can be determined depending on the concentration of the solution and the amount of the solution to be applied as in the case of the one-stage one-bath method.

The coloring agent is then applied to the fibrous structure to which the prepolymer of synthetic resin has thus been applied. The preparation of a solution containing the coloring agent can be the same as in the one-stage one-bath method described above except that the prepolymer and related materials are not added, and the method of application can also be the same. The fibrous structure to which the coloring agent is applied can be wet, but preferably, it is pre-dried. The pre-drying can be conducted at ambient temperatures or under appropriate heating. The heating temperature can range up to 130° C but not sufficiently high to cause reaction of the prepolymer of the synthetic resin. The pre-drying is generally conducted at a temperature of about 60° to 120° C for about 1 to 10 minutes. The fibrous structure is then heat-treated.

Thus, the fibrous structure to which the prepolymer and the coloring agent have been applied by the two-stage two-bath method is, if desired, pre-dried, and heat-treated.

In the two-stage two-bath method described above, the prepolymer can be incorporated in the solution containing the coloring agent. Furthermore, this method has the advantage that when a catalyst for the prepolymer is included in the solution containing the coloring agent, the stability of the first-stage bath, that is, the solution containing a prepolymer of a synthetic resin, is increased. Moreover, this method makes it possible to provide a new discharge printing method for a relatively simple coloring pattern, in which the prepolymer is applied to the fibrous structure in a desired pattern, and then the coloring agent is applied by pad-dyeing, followed by heat-treatment and treatment with a reducing agent. This is shown in the Examples described hereinafter.

The two-stage two-bath method in which the coloring agent is first applied to the fibrous structure and then the prepolymer is applied can be performed in a similar manner except that the sequence of the steps differs. This method has the advantage that by applying the prepolymer on the entire surface of the fibrous structure by padding, coating, spraying, etc., after the application of the coloring agent and then heat-treating and treating the fibrous structure with a reducing agent, the resin finishing of the fibrous structure and the fixation of the coloring agent can be performed at the same time, and a colored fibrous structure free from contamination and having brilliant and very fast colors can be obtained. Thus, this method is suitable where it is desired to subject the fibrous structure to resin finishing.

A primary essential feature of the present invention is that the coloring agent, the prepolymer and the fibrous structure should be integrally bonded to each other. Since it is only necessary that both the coloring agent and the prepolymer be copresent on the fibers, the various methods of application described above can be optionally employed according to the advantages and characteristics of the respective methods and the results desired. Any of these methods gives good results.

The fibrous structure to which the coloring agent and the prepolymer of a synthetic resin have been applied by the one-stage one-bath method or the two-stage two-bath method is then heat-treated.

The heat-treatment, in conjunction with the treatment with reducing agents to be described, is an essential step in the present invention, but the conditions for it, such as the temperature, humidity, time or the amount of air present, differ somewhat depending on the type of coloring agent, the type of prepolymer, and the type and amount of latent acidic catalyst used as required. Generally, however, the heat-treatment temperature is about 100° to 220° C, preferably 130° to 210° C. The heat-treatment time generally ranges from about 0.1 to 10 minutes, preferably about 0.3 to 5 minutes. The heating can be carried out by either steam heating or dry heating, and such heating can be applied to the fibrous structure directly or indirectly or both. For example, the heating can be effected using steam, electric power, gas-flame, hot air, infrared rays, or microwave energy, using such a device as a heat roll or a heat chamber.

The fibrous structure so treated is, if desired, washed, and then treated with a reducing agent. This treatment with the reducing agent is also essential in the present invention. Only by carrying out this treatment in conjunction with the heat-treatment of fixing the coloring agent to the fibrous structure in the presence of the prepolymer, can the unique effects of the present invention be realized. Even those coloring agents which have the property of being decolorized or discolored by reducing agents, such as reactive dyes, direct dyes or acid dyes, do not at all undergo change by the reducing agents when the fibers, the coloring agent and the prepolymer are integrally bonded by the heat-treatment. When this condition is not satisfied, such coloring agents are decolorized or removed by the reducing agents.

Thus, in accordance with the process of this invention, the problems associated in the conventional dyeing or printing, i.e., the contamination of colored portions and/or white background with fixed dyes which have been considered extremely difficult to wash out and remove, can completely be solved for the reasons described above and, in addition, colored fibrous structures having superior brilliancy and fastness can be obtained. Furthermore, various assistants, unreacted matter, or additives used in the pre-stage process which are usually difficult to remove by washing can also be decomposed, and removed, and this also appears to contribute to the good fastness and brilliancy of the colored products.

Examples of suitable reducing agents which can be used in this treatment include hydrogen and relatively unstable hydrogen compounds such as hydrogen iodide, hydrogen sulfide, lithium aluminum hydride or sodium boro hydride; lower oxides or salts of lower oxygenic acid, such as carbon monoxide, sulfur dioxide, thiourea dioxide or sulfites; sulfur compounds such as sodium sulfide, polysodium sulfide or ammonium sulfide; metals having high electropositivity (or amalgams thereof), such as alkali metals, magnesium, calcium, aluminum, or zinc, salts of low oxidation valence state metals such as iron (II), tin (II), titanium (III) or chromium (II); organic compounds in a low oxidation stage such as aldehydes, saccharides; and reducing agents usually employed for decolorization of fibers, such as sodium bisulfite, Na-sulfoxylate formaldehyde (for example, Rongalit, trade name produced by BASF, or Sulfoxite C, trade name produced by Du Pont), modified primary zinc salts of formaldehyde sulfoxylic acid (for example, Decrolin Soluble Conc., trade name produced by BASF, or Sulfoxite S Conc., trade name produced by Du Pont), and hydrosulfite (sodium dithionate). Of these, those reducing agents exemplified above usually used for decolorization of fibers are especially preferred. Above all, hyydrosulfite and formaldehyde-modified sulfoxylates are suitably used in this invention.

The above-described reducing agent, either alone or together with an alkali agent such as sodium hydroxide, sodium silicate, lime, ammonia, sodium sesquicarbonate, sodium phosphate, sodium polyphosphate, borax or soap, is dissolved in water, for example, to form a solution. If desired, a non-ionic surface active agent such as a polyoxyethylene alkylaryl ether or alkylol amide or an anionic surface active agent such as an ester of a higher alcohol and sulfuric acid, sodium alkylmethyl tauride, or sodium alkylaryl sulfonate is additionally added to the solution as an emulsifier or a penetrating, wetting or dispersing agent to proide improved results. The reducing agent treatment is performed at a temperature of about 20° to 130° C and the amount of the reducing agent which can be suitably used in the present invention is about 0.05 by 5% by weight, preferably 0.1 to 3% by weight, based on the weight of the fibers. In case of treating using a pad-nip process, the fibrous materials can be dipped in a reducing agent-containing solution having a concentration as described above or a slightly lower concentration, immediately squeezed to about 70 to 120% followed by steaming for about 5 seconds to 3 minutes and then washed. Alternately, in dip-dyeing, the fibrous materials can be dipped into a reducing agent-containing solution having a concentration as described above so as that the dye-bath ratio becomes about 1:10 to 1:200, preferably about 1:50 to 1:100, and treated for about 5 to 60 minutes, preferably 10 to 30 minutes followed by washing. In either of the above two cases, the conventional reduction-washing methods can be employed in the present invention.

The treatment of the heat-treated fibrous structure with the solution of a reducing agent so prepared can be performed by dipping the fibrous structure in the solution and the solution is then stirred. Alternatively the solution can be applied to the fibrous structure using methods such as padding, spraying or coating, followed by steaming. When the coloring agent is applied by the pad-dyeing method, it is especially desirable to perform the latter-described treatment with a reducing agent.

This reducing agent treatment makes it possible to remove the unfixed coloring agent, which is a main contaminant in the colored fibrous structure, without impairing the color of the dye-fixed portions, and to give colored fibrous structures having superior brilliancy and fastness characteristics.

Thus, according to the process of this invention, not only fibrous structures composed of a single kind of fibers, but also those composed of a mixture of different kinds of fibers the coloring of which has previously required extremely complicated procedures can be colored superior colors with good fastness characteristics using a very simplified operation with conventional equipment, dyes, assistants, and additives.

As examples of the especially outstanding effects obtainable by the method of this invention, the coloring of a fibrous structure obtained by mix-spinning or interweaving or interknitting polyethylene terephthalate and cotton, viscose or flax, which is a typical mix-spun fibrous structure having a wide range of utility, may be mentioned. When this fibrous structure is subjected to printing or dyeing using a combination of a disperse dye/direct dye, disperse dye/reactive dye, etc., which have extremely different dyeability for the polyethylene terephthalate and the cotton, viscose or flax which constitute the fibrous structure, together with the prepolymer of a synthetic resin, and then after fixation, treated with a reducing agent, the contaminants are completely removed, and a colored fibrous structure having superior brilliancy and fastness characteristics not comparable to those obtained with the conventional techniques can be obtained.

The process of this invention produces especially outstanding effects on fibrous structures consisting of, or comprising, cellulosic fibers. It is also applicable with equally superior results to the coloring of a fibrous structure composed of acetate and silk with a mixture of a disperse dye and an acid dye, the coloring of a fibrous structure composed of a polyester and wool with a mixture of a disperse dye and an acid or reactive dye, etc.

The following Examples specifically illustrate the present invention in greater detail without any intention to limit the invention thereto.

In the Examples, all percentages are by weight unless otherwise indicated. The wash fastness was measured in accordance with JIS L-1045 ('59) MC-2 where the sample was washed for 30 minutes with a 0.5% soap solution at a temperature of 50± ° C using a laund-O-meter. The rubbing fastness was measured in accordance with JIS L-1048 ('59) where a load of 200g was exerted on the sample and the sample was reciprocated 100 times, using a friction tester. The light fastness was measured in accordance with JIS L-1044 ('59) after irradiating the sample for 20 hours using a fade-O-meter (carbon arc, 135 ±10V, 16±1A; temperature 63±3° C; RH less than 50%). The discoloration degree was evaluated using a gray scale specified in JIS L-0804. The degree of contamination was evaluated using a gray scale specified in JIS L-0805.

EXAMPLE 1

Each of the dye liquors $D_1$ and $D_2$ shown in Table 2 below as padded on a mix-spun broad cloth composed of 65% of polyester and 35% of cotton using a mangle to a pick-up of 70%, and the cloth was dried in hot air at 80° C. Each of the cloths so colored was heat-treated at 180° C for 3 minutes to fix the dye, and then washed with flowing cold water at 20° C for 5 minutes, and then twice washed with warm water at 60° C fo 5 minutes. The goods-to-warm water ratio was 1:100. Then, water was centrifugally removed from the cloth to a moisture content of 30%, and the cloth was dried in air at room temperature (about 20° to 30° C) to form samples $S'_1$ and $S'_2$. Sample $S'_2$ thus obtained was then divided into two portions and one of which is designated as $S'_3$. The other portion was then padded with dye liquor $D_3$ (to a pick-up of 70%), dried in hot air at 80° C and then heat-treated at 150° C for 3 minutes to fix the resin. Thus, a dyed and resin-finished product $S'_4$ in two baths was obtained.

TABLE 2

| Constituents | Dye Liquors $D_1$ (%) | $D_2$ (%) | $D_3$ (%) |
|---|---|---|---|
| Cibacron Brilliant Red BD (reactive dye, product of Ciba Limited) | 3.0 | 3.0 | — |
| Foron Scarlet S-BWFL Liquid (disperse dye, product of Sandoz A.G.) | 3.0 | 3.0 | — |
| 50% Solution of Dimethylol Dihydroxy Ethylene Urea | 10.0 | — | 10.0 |

TABLE 2-continued

| Constituents | Dye Liquors $D_1$ (%) | $D_2$ (%) | $D_3$ (%) |
|---|---|---|---|
| Sodium Alginate | 0.1 | 0.1 | — |
| Water | 81.9 | 80.9 | — |
| Urea | — | 10.0 | — |
| 50% Solution of Ammonium Chloride | 1.0 | — | 1.0 |
| Sodium Bicarbonate | — | 2.0 | — |

Each of the dyeings $S'_1$, $S'_3$ and $S'_4$ was then treated in a reducing bath at 80° C containing 2g/liter of 42% NaOH, 2g/liter of hydrosulfite conc., and 2g/liter of a nonionic surface active agent (Sunmol RC, trade name for a polyoxyethylene alkylamine, product of Nikka Chemical Co., Ltd.) for 10 minutes with a goods-to-bath ratio of 1:100. Thereafter, each of the treated dyeings was thoroughly washed with cold water, and then dried to give samples $S_1$, $S_3$ and $S_4$ respectively.

The dyeing $S'_2$ was separately soaped for 10 minutes in a soaping bath at 80° C containing 2g/liter of Marseilles soap with a goods-to-bath ratio of 1:100, and then thoroughly washed with cold water, followed by drying to form sample $S_2$. The properties obtained of the resulting dyeings $S_1$, $S_2$, $S_3$ and $S_4$ are shown in Table 3.

TABLE 3

| Samples | Dye Liquors | Colors | Wash Fastness: Discoloration Grade | Wash Fastness: Contamination Grade | Fastness to Rubbing: Dry | Fastness to Rubbing: Wet | Light Fastness (20 hours) |
|---|---|---|---|---|---|---|---|
| $S_1$ | $D_1$ | Brilliant deep red | 5 | 5 | 5 | 5 | 5–6 |
| $S_2$ | $D_2$ | Deep red | 4 | 3–4 | 3–4 | 3–4 | 3–4 |
| $S_3$ | $D_2$ | Mottled red | 5 | 5 | 5 | 5 | 5–6 |
| $S_4$ | $D_2$–$D_3$ | Brilliant deep red | 5 | 5 | 5 | 5 | 5–6 |

It is clear from the above table that the samples $S_1$ and $S_4$ in accordance with the process of this invention have an outstandingly brilliant color and extremely superior fastness, whereas the sample $S_2$ obtained by washing using an ordinary soaping operation without including the prepolymer of a synthetic resin in the coloring composition suffered from a lack of brilliancy of the color as a result of contamination with the disperse dye, and had poor fastness characteristics.

Furthermore, in the sample $S_3$ which was obtained by reducing and washing a fabric to which a coloring composition containing no prepolymer had been fixed, the reactive dye (Cibacron Brilliant Red BD) fixed to cotton was decolorized at the time of reduction, and only the polyester portion was dyed.

EXAMPLE 2

A mix-spun broad cloth composed of 65% of polyester and 35% of cotton was subjected to pad-dyeing using a solution of the prepolymer as shown in Table 4 below and squeezed by a mangle to a pick-up of 70%, followed by drying in hot air at 80° C to form samples $R_1$, $R_2$, $R_3$ and $R_4$.

TABLE 4

| Composition | Resin Solution (Sample No.) $R'_1$ ($R_1$) (%) | $R'_2$ $R_2$) (%) | $R'_3$ ($R_3$) (%) | $R'_4$ ($R_4$) (%) |
|---|---|---|---|---|
| 50% Aqueous Solution of Dimethylol Dihydroxy Ethyleneurea | — | 6 | 12 | 12 |
| Water | 98 | 92 | 85 | 86 |
| 50% Aqueous Solution of Ammonium Chloride | — | — | 1 | — |
| Pallasofter VNT[1] | 2 | 2 | 2 | 2 |

[1]Pallasofter VNT (trade name for a nonionic softener of a higher alkyl polyamine type, product of Ohara Palladium Chemical Co., Ltd.)

The dye liquors shown in Table 5 were then prepared. Each of the samples $R_1$, $R_2$, $R_3$ and $R_4$ was subjected to pad-dyeing using these dye liquors, and squeezed to a pick-up of 70%, and then dried in hot air at 80° C.

Each of the dyed samples was heat-treated for 3 minutes in dry heat at 170° C, and then washed with flowing water for 5 minutes at 20° C, followed by washing with warm water at 40° C for 5 minutes with a goods-to-water ratio of 1:100. Then, each of the samples was soaped for 5 minutes with a soaping solution at 50° C containing 2g/liter of Marseilles soap and 2g/liter of soda ash with a goods-to-solution ratio of 1:100, followed by washing with flowing water at 20° C until the soap was removed. Then, the sample was centrifuged to remove water to a moisture content of 50%, followed by allowing the material to dry in the air. Dyeings $S_{1A}$, $S_{2A}$, $S_{3A}$, $S_{4A}$, $S_{1B}$ . . . and $S_{4C}$ were obtained. (1, 2, 3 and 4 show the numbers of the resin solutions used, and A, B and C show the numbers of the dye liquors used.)

TABLE 5

| Composition | Numbers of Dye Liquors $D_A$ (%) | $D_B$ (%) | $D_C$ (%) |
|---|---|---|---|
| Foron Scarlet S-BWFL liquid (disperse dye of Sandoz AG) | 7.0 | 7.0 | 7.0 |
| Cibacron Scarlet RP (reactive dye of Ciba Limited) | 3.0 | 3.0 | 3.0 |
| 50% Aqueous Solution of Dimethylol Dihydroxyethyleneurea | — | — | 6.0 |
| Sodium Alginate | 0.1 | 0.1 | 0.1 |
| Water | 77.9 | 88.9 | 83.9 |
| Urea | 10 | — | — |
| 50% Aqueous Solution of Ammonia Chloride | — | 1.0 | 1.0 |
| Sodium Bicarbonate | 2 | — | — |

Then each of the dyeings $S_{1A}$, $S_{2A}$, $S_{3A}$, $S_{4A}$, $S_{1B}$, $S_{2B}$, $S_{3B}$, $S_{4B}$, $S_{1C}$, $S_{2C}$, $S_{3C}$ and $S_{4C}$ was treated in a reducing bath at 60° C containing 5cc/liter of NaOH (38° Be), 2g/liter of hydrosulfite conc. and 2cc/liter of a surfactant Sunmol RC (product of Nikka Chemical Co., Ltd.) for 10 minutes, with a goods-to-bath ratio of 1:50. Thereafter, the treated samples were thoroughly washed with cold water, and dried to form dyeings $S'_{1A}$, $S'_{2A}$, $S'_{3A}$, $S'_{4A}$, $S'_{1B}$, $S'_{2B}$, $S'_{3B}$, $S'_{4B}$, $S'_{1C}$, $S'_{2C}$, $S'_{3C}$ and $S'_{4C}$. The properties of the dyeings which were either subjected or not subjected to a reducing treatment are shown in Table 6.

The color fastness was examined only with respect to those samples in which both the polyester portion and the cotton portion were dyed in a satisfactory condition. The term "mottled" means that only one of the two fibers constituting the fibrous structure was dyed.

TABLE 6

| Dyeings | Resin Solutions | Dye Liquors | Reducing and Washing | Color | Wash Fastness Discoloration Grade | Wash Fastness Contamination Grade | Rub Fastness Dry | Rub Fastness Wet | Light Fastness (20 hours) |
|---|---|---|---|---|---|---|---|---|---|
| S 1A | 1 | A | No | Mottled red | — | — | — | — | — |
| S'1A | 1 | A | Yes | Mottled red | — | — | — | — | — |
| S 2A | 2 | A | No | Slightly mottled brilliant deep red | 2–3 | 3–4 | 4 | 3–4 | 4 |
| S'2A | 2 | A | Yes | Mottled red | — | — | — | — | — |
| S 3A | 3 | A | No | Deep red | 3 | 3–4 | 4 | 3 | 4 |
| S'3A | 3 | A | Yes | Brilliant deep red | 4 | 4–5 | 4–5 | 3–4 | 5–6 |
| S 4A | 4 | A | No | Slightly mottled deep red | 3 | 3–4 | 4 | 3 | 4 |
| S'4A | 4 | A | Yes | Brilliant deep red | 4 | 4–5 | 4–5 | 3–5 | 5–6 |
| S 1B | 1 | B | No | Mottled red | — | — | — | — | — |
| S'1B | 1 | B | Yes | Mottled red | — | — | — | — | — |
| S 2B | 2 | B | No | Slightly mottled deep red | 3 | 3–4 | 4 | 3 | 4 |
| S'2B | 2 | B | Yes | Slightly mottled brilliant deep red | 4 | 4–5 | 4–5 | 3–4 | 5–6 |
| S 3B | 3 | B | No | Deep red | 3 | 3–4 | 4 | 3 | 4 |
| S'3B | 3 | B | Yes | Brilliant deep red | 4 | 4–5 | 4–5 | 4 | 5–6 |
| S 4B | 4 | B | No | Deep red | 3 | 3–4 | 3–4 | 3 | 4 |
| S'4B | 4 | B | Yes | Brilliant deep red | 4 | 4–5 | 4–5 | 3–4 | 5–6 |
| S 1C | 1 | C | No | Slightly mottled deep red | 2–3 | 3–4 | 4 | 3–4 | 4 |
| S'1C | 1 | C | Yes | Mottled red | — | — | — | — | — |
| S 2C | 2 | C | No | Deep red | 3 | 3–4 | 4 | 3 | 4 |
| S'2C | 2 | C | Yes | Brilliant deep red | 4 | 4–5 | 4–5 | 3–4 | 5–6 |
| S 3C | 3 | C | No | Deep red | 3 | 3–4 | 4 | 3 | 4 |
| S'3C | 3 | C | Yes | Brilliant deep red | 4–5 | 4–5 | 4–5 | 3–4 | 5–6 |
| S 4C | 4 | C | No | Deep red | 3 | 3–4 | 4 | 3 | 4 |

TABLE 6-continued

| Dyeings | Resin Solutions | Dye Liquors | Reducing and Washing | Color | Wash Fastness Discoloration Grade | Wash Fastness Contamination Grade | Rub Fastness Dry | Rub Fastness Wet | Light Fastness (20 hours) |
|---|---|---|---|---|---|---|---|---|---|
| S'4C | 4 | C | Yes | Brilliant deep red | 4–5 | 4–5 | 4–5 | 3–4 | 5–6 |

It can be seen from the results in Table 6 that $S'_{2C}$, $S'_{3A}$, $S'_{3B}$, $S'_{3C}$, $S'_{4A}$, $S'_{4B}$ and $S'_{4C}$ which are in accordance with the present invention have outstanding brilliant colors and superior fastness characteristics as compared with $S_{1A}$ in accordance with the conventional process. This demonstrates that superior effects can be obtained even when the prepolymer is first applied to the fibrous structure, and then the coloring agent is applied thereto.

The colors on the $S'_{2A}$ and $S'_{2B}$ became slightly mottled and this is because the amount of the resin was smaller than the amount of the dye. A comparison of these with $S'_{2C}$ and $S'_{3A}$, $S'_{3B}$, $S'_{4A}$, $S'_{4B}$ shows that the application of the prepolymer of a synthetic resin can be performed in a single step, or a portion of the prepolymer can be applied together with the coloring agent. On the other hand, $S'_{4A}$ which was obtained without using ammonium chloride as a catalyst showed a slightly mottled tone although it was dyed a brilliant deep red. This demonstrates that the addition of catalyst is preferred. It should be noted that all of the dyeings in accordance with this invention exhibited superior fastness characteristics.

EXAMPLE 3

A mercerized satin cloth composed of 100% cotton was used, and a solution of the prepolymer shown in Table 7 was applied to the entire surface of the cloth by roll printing, followed by drying in hot air at 50° C. Then, using a printing dye liquor of the formulation shown in Table 8, the cloth was subjected to roll printing to print a varying pattern on the coating of the prepolymer. The cloth was then dried with hot air at 80° C, and heat-treated for 2 minutes at 190° C. The cloth was then washed with flowing water for 3 minutes, and then with warm water at 80° C for 5 minutes with the goods-to-water ratio being 1:100. The cloth was then padded with a reducing solution to a pick-up of 80%, which contains 20cc/liter of NaOH (38° Be), 20g/liter of hydrosulfite conc., and 2cc/liter of Sunmol RC 700 (product of Nikka Chemical Co., Ltd.), and then immediately steamed for 30 seconds. The treated cloth was washed with warm water at 50° C for 10 minutes, and dried. The resulting printed cloth was designated Example A.

TABLE 7

| | |
|---|---|
| Trimethylol Melamine | 7.0% |
| Water | 87.8 |
| Carboxymethyl Cellulose | 4.0 |
| Aqueous Ammonia | 0.2 |
| Padding Auxiliary 4278, (registered trademark of an anionic penetrant, product of Bayer AG) | 1.0 |

TABLE 8

| | |
|---|---|
| Xylene Red B 400% (acid dye, product of Sandoz AG) | 1.0% |
| Water | 97 |
| Sodium Alginate | 1.0 |

TABLE 8-continued

| | |
|---|---|
| Ammonium Nitrate (50% solution) | 1.0 |

On the other hand, using the same cloth as used in preparing the Example A cloth, a solution containing both the prepolymer and the coloring agent as shown in Table 9 was applied thereto by roll printing, followed by drying in hot air at 80° C and heat-treatment at 190° C for 2 minutes, and further similar washing and reducing treatments as performed in obtaining the Example A sample. The resulting printed cloth was designated Example B.

TABLE 9

| | |
|---|---|
| Trimethylol Melamine | 7.0% |
| Xylene Red B 400% | 1.0 |
| Water | 84.8 |
| Carboxymethyl Cellulose | 3.0 |
| Sodium Alginate | 1.0 |
| Aqueous Ammonia | 0.2 |
| Anionic Penetrant (same as in Table 7) | 1.0 |
| Ammonium Nitrate (50% solution) | 1.0 |

Furthermore, in the preparation of the Example A sample, a varying pattern was printed on the cloth using the dye liquor of the formulation shown in Table 8, and thereafter drying with hot air at 80° C, the resin solution of the formulation shown in Table 7 was applied thereto by roll printing. Otherwise, the procedure and conditions were the same as in the preparation of the Example A sample. There was obtained a printed cloth which was designated Example C.

The colors of the dyed portions and the varying non-dyed portions were examined by the naked eye on each of the resulting cloths (Examples A to C), and the fastness characteristics and discoloration of the dyed portions were examined. The results obtained are shown in Table 10. The reflection rate of the non-dyed portion was measured at 430mμ using a spectrophotometer (Model EPU-II, product of Hitachi Limited). The results obtained are also shown in Table 10.

For the sake of reference, the preparation of the Example A sample was repeated except that the resin solution was applied to the cloth in a varying pattern using roller printing, and then a coloring solution of . o of Xylene Red B 400%, 0.1% of sodium alginate, 1.0% of a 50% aqueous solution of ammonium nitrate, and 97.9% of water was padded on the cloth, followed by squeezing to a pick-up of 76% to provide the same dye pick-up. The resulting dyed cloth was designated Example D. The various properties were measured in the same way.

For comparison, a printed cloth was prepared in the same way as in the preparation of the Example A sample except that the trimethylol melamine was not used. The resulting cloth was designated Comparative Example A. Also, the preparation of the Example A sample was repeated except that the reducing treatment was not performed. The resulting printed cloth was designated Comparative Sample B. The properties of the Comparative Examples were also measured in the same way, and the results obtained are shown in Table 10.

TABLE 10

| Sample No. | Dyed Portion | Undyed Portion (Varying Portion) | Reflection of the Varying Portion (%) | Wash Fastness Discoloration Grade | Wash Fastness Contamination Grade | Rubbing Fastness Dry | Rubbing Fastness Wet | Light Fastness (20 hours) |
|---|---|---|---|---|---|---|---|---|
| Example A | Brilliant red | Pure white | 89.4 | 4–5 | 4–5 | 4–5 | 4 | 5–6 |
| Example B | Brilliant red | Pure white | 89.2 | 4–5 | 4–5 | 4–5 | 4 | 5–6 |
| Example C | Brilliant red | Pure white | 89.5 | 4–5 | 4–5 | 4–5 | 4 | 5–6 |
| Example D | Brilliant red | Almost pure white | 88.6 | 4–5 | 4–5 | 4–5 | 4 | 5–6 |
| Comparative Example A | Reddish white | Slightly reddish white | 83.1 | — | — | — | — | — |
| Comparative Example B | Dark red | Slightly reddish white | 84.5 | 3 | 3–4 | 4 | 3–4 | 4 |

As can be seen from the results in Table 10, good results are obtained in the case of the Examples of the present invention. In the case of the Example D sample, the cloth dyed entirely red was subjected to discharge printing as a result of the reducing treatment to present a varying pattern. This is for the purpose of comparison. For practical applications, it is of course economically advantageous to perform printing so that the application of the coloring agent is made to correspond with the application of the prepolymer. However, this method is effective for obtaining a special pattern. When the Comparative Example A sample was further subjected to a reducing treatment, a slightly reddish white (reflection rate 86.7%) was presented in which the pattern could be scarcely discriminated.

EXAMPLE 4

A dye liquor of the formulation shown in Table 11 below with varying resins was padded on a T/C broad cloth composed of 50% polyester and 50% cotton. The cloth was dried in hot air at 80° C, and heat-treated at 160° C for 3 minutes to fix the dye and the resin. The cloth was then washed with flowing water for 3 minutes, and then washed with warm water at 80° C for 5 minutes with a goods-to-water ratio of 1:100. The cloth was then soaped for 5 minutes with a soaping solution at 60° C containing 2g/liter of Marseilles soap, washed thoroughly with water, and the water removed and dried. Subsequently, it was padded with a bath containing 10g/liter of NaOH (38° Be), 10g/liter of hydrosulfite conc., and 2g/liter of Sunmol RC (product of Nikka Chemical Co., Ltd.), and immediately then steamed for 30 seconds. The cloth so treated was then washed with warm water at 80° C for 10 minutes, and dried.

TABLE II

| | |
|---|---|
| Samaron Brilliant Scarlet RS Liquid (disperse dye of Hoechst AG) | 3.0% |
| Procion Scarlet H-R (reactive dye of ICI) | 3.0 |
| Solution Containing the Prepolymer of a Synthetic Resin (Shown in Table 12) | 10.0 |
| Water | 82.9 |
| Sodium Alginate | 0.1 |
| Ammonium Nitrate (50% solution) | 1.0 |

The appearance and fastness characteristics of the resulting colored fibrous structures were examined, and the results obtained are shown in Table 12.

TABLE 12

| Runs Nos. | Prepolymers of Synthetic Resins | Appearance | Wash Fastness Discoloration Grade | Wash Fastness Contamination Grade | Rubbing Fastness Dry | Rubbing Fastness Wet | Light Fastness (20 hours) |
|---|---|---|---|---|---|---|---|
| 1 | Monomethylol Ethyleneurea | Brilliant deep red | 4–5 | 4–5 | 4–5 | 4 | 5 |
| 2 | Dimethylol Urone | Brilliant deep red | 4–5 | 4–5 | 4–5 | 4 | 4–5 |
| 3 | Trioxane | Slightly dark brilliant deep red | 4–5 | 4–5 | 4 | 4 | 4–5 |
| 4 | Glyoxal | Slightly dark brilliant deep red | 4–5 | 4–5 | 4 | 3–4 | 4–5 |
| 5 | Hexamethylol Melamine | Brilliant deep red | 4–5 | 4–5 | 4–5 | 4 | 5 |
| 6 | Dimethylol Triazone | Brilliant deep red | 4–5 | 4–5 | 4–5 | 4 | 4–5 |
| 7 | Dimethylol Hydroxyethyl Triazone | Brilliant deep red | 4–5 | 4–5 | 4–5 | 4 | 4–5 |

As can be seen from the results in Table 12, good results are obtained in either case. Although in using an aldehyde-type prepolymer, the color of the fibrous srtucture obtained was slightly dark, but the effect was superior.

EXAMPLE 5

A knitted fabric produced from a mix-spun yarn composed of 50% of polyester and 50% of cotton was padded with a coloring composition as shown in Table 13, dried in hot air at 80° C, and subsequently, heat-treated for 3 minutes at 150° C to fix the resin. By steaming the fabric at 130° C under high pressure for 30 minutes, the dye was fixed to the fabric.

TABLE 13

| | |
|---|---|
| Xylene Red B (acid dye of Sandoz AG) | 1.0% |
| Palanil Brilliant Blue BGF Liquid (disperse dye of BASF) | 6.0 |

TABLE 13-continued

| | |
|---|---|
| Tetraoxane | 8.0 |
| Water | 83.0 |
| Magnesium Chloride (30% solution) | 2.0 |

The fabric was then washed with cold water and then twice with warm water at 60° C for 10 minutes. The fabric was further treated for 10 minutes at 80° C in a reducing bath of 2g/liter of NaOH (38° Be), 2g/liter of hydrosulfite conc. and 2g/liter of Sunmol RC, soaped with a soaping bath containing 2g/liter of Sunmol RC at 80° C for 5 minutes, washed with warm water at 60° C, and dried. The cloth thus obtained showed a beautiful dyeing in which brilliant pink portions were mix-scattered in a brilliant blue background.

EXAMPLE 6

A woven fabric prepared from a mix-spun yarn composed of 50% of polyester and 50% of wool was subjected to screen printing using a printing paste of the formulation as shown in Table 14, and a 120-mesh polyester gauze screen, and dried in hot air at 80° C. The fabric was subsequently heat-treated in dry heat at 180° C for 3 minutes to fix the resin. The fabric was further subjected to steaming at 102° C for 3 minutes.

TABLE 14

| | |
|---|---|
| Remazol Black B (reactive dye of Hoechst AG) | 4.0% |
| Cibacron Brilliant Orange GP (reactive dye of Ciba-Geigy) | 1.0 |
| Terasil Black SRL Liquid 50% (disperse dye of Ciba-Geigy) | 10.0 |
| Water | 4.0 |
| Half Emulsion Paste of Sodium Alginate | 70.0 |
| 50% Aqueous Solution of Dimethylol Dihydroxyethyleneurea | 10.0 |
| 50% Solution of Ammonium Chloride | 1.0 |

The fabric was then washed with cold water, washed twice with warm water at 60° C for 10 minutes, and treated for 20 minutes at 50° C with a reducing bath of 40g/liter of sodium acetate, 5g/liter of sodium-sulfoxylate formaldehyde, and 2cc/liter of a nonionic surfactant (Peletex WA, a trade name for a polyoxyethylene alkylamine, by Miyoshi Oil and Fat Co., Ltd.) with a goods-to-bath ratio of 1:50. The fabric was then soaped with a soaping bath containing 2cc/liter of an anionic detergent (Osmolex, a trade name for a sodium alkylbenzenesulfonate, produced by Nikka Chemical Co., Ltd.). washed thoroughly with warm water at 50° C, and the water removed and dried to form a printed fabric having a black pattern on a white background.

The resulting printed fabric had a light fastness grade of 5, a wash fastness grade of 4, a rubbing fastness grade of 5, and a wet rubbing fastness grade of 4.

EXAMPLE 7

A printing paste of the formulation shown in Table 14 was similarly printed on a cloth prepared from a mix-spun yarn composed of 70% of acetate and 30% of silk. After fixing, the cloth was thoroughly washed with water, treated with a reducing and washing bath containing 10cc/liter of aqueous ammonia, 0.2g/liter of thiourea dioxide and 2cc/liter of a nonionic surfactant (Peletex WA) at 50° C for 10 minutes, and then soaped with a soaping bath containing 2cc/liter of an anionic detergent (Osmolex). The cloth was thoroughly washed with warm water, dried to form a printed cloth having a black pattern on a white backgrond. This cloth exhibited a grade of 4 to 5 in all of the color fastness characteristics.

EXAMPLE 8

A broad cloth of a mix-spun yarn composed of 70% of polyester and 30% of flax was padded with a resin solution of the formulation shown in Table 15, and dried in hot air at 50° C. A printing paste of the formulation shown in Table 16 was printed thereon by screen printing, dried in hot air at 120° C, and heat-treated at 200° C for 35 seconds by which thermosol color development was also effected.

TABLE 15

| | |
|---|---|
| Tetraoxane | 2.0% |
| Dimethylol Dihydroxy Ethyleneurea (50% solution) | 5.0 |
| Dimethylol Propyleneurea (50% solution) | 5.0 |
| Palladium SA[1] | 3.0 |
| Pallasofter N110[2] | 2.0 |
| 30% Aqueous Solution of Magnesium Chloride | 4.0 |
| Water | 79.0 |

[1]Nonionic water-repelling agent, trade name for a silicone oil water repelling agent, a product of Ohara Palladium Co., Ltd.
[2]Nonionic softener, trade name for a polyoxyethylene alkylpolyamine, a product of Ohara Palladium Co., Ltd.

TABLE 16

| | |
|---|---|
| Kayalon Polyester Turquoise Blue GL-SF Liquid (disperse dye, product of Nippon Kayaku Seizo Kabushiki Kaisha) | 4.0% |
| Cibacloran Brilliant Blue 8G (direct dye for wool, product of Ciba Limited) | 1.0 |
| Samaron Brilliant Yellow 6GSL Liquid (disperse dye, product of Hoechst AG) | 2.0 |
| Remazol Brilliant Yellow GGL (reactive dye for cotton, product of Hoechst AG) | 1.0 |
| Half Emulsion Paste of Sodium Alginate | 92.0 |

The cloth was then washed with cold water, washed twice with warm water at 60° C, and treated with a bath containing 2g/liter of NaOH (38° Be), 2g/liter of hydrosulfite conc., and 2cc/liter of Unicasalt C-50 (nonionic surfactant, trade name for a polyoxyethylene alkylamine, a product of Union Chemical) at 60° C for 10 minutes. The cloth was further washed twice with warm water at 80° C, and dried to form a beautiful and fast printed cloth in which green portions were varying on a soil-free white background. The cloth was also resin finished in consequence, and the product had good wash and wear properties and was almost free from any free formaldehyde odor.

EXAMPLE 9

A coloring composition as shown in Table 17 was printed on an interwoven broad cloth composed of 50% polyester and 50% cotton by screen printing, dried, and heat-treated at 200° C for 1 minute, thereby to fix the dyes.

TABLE 17

| | |
|---|---|
| Procion Supranol Yellow H8GP | 2.0% |
| Samaron Brilliant Yellow 6GSL Liquid | 2.0 |
| Cibacron Brilliant Yellow 8G | 1.0 |
| Palanil Brilliant Blue BGF Liquid | 2.0 |
| 50% Solution of Dimethylol Propyleneurea | 8.0 |

TABLE 17-continued

| | |
|---|---|
| 70% Solution of Trimethylol Melamine | 2.0 |
| Half Emulsion Paste of Sodium Alginate | 82.0 |
| 50% Solution of Ammonium Nitrate | 1.0 |

The cloth was then washed with water for 5 minutes, and washed with warm water at 60° C for 10 minutes with the goods-to-water ratio being 1:200. The cloth was then dipped for 2 minutes in a reducing liquid at 25° C of 10g/liter of 42% NaOH, 20g/liter of hydrosulfite and 2g/liter of Sunmol RC (product of Nikka Chemical Co., Ltd.) with the goods-to-liquid ratio being 1:50. The cloth was further dipped for 5 minutes in a hot water bath at 98° C with the goods-to-wear ratio being 1:100. Subsequently, the cloth was soaped with a soaping bath at 80° C containing 2g/liter of Sunmol RC with the goods-to-bath ratio being 1:100. The treated cloth was washed for 5 minutes with flowing water, and dried to form a printed cloth which was colored a brilliant green.

The printed cloth had a light fastness grade of 5, a wash fastness grade of 5, a dry rubbing fastness grade of 5, and a wet rubbing fastness grade of 4. The whiteness of the non-colored portions were subsequently the same as the whiteness of the original cloth, showing substantially no contamination.

While the invention has been described in detail and with reference to specific embodiments thereof, it will be apparent to one skilled in the art that various changes and modifications can be made therein without departing from the spirit and scope thereof.

What is claimed is:

1. A process for coloring a fibrous structure consisting essentially of fibers selected from the group of natural fibers, semi-synthetic fibers and synthetic fibers which comprises applying a solution of a coloring agent and a methylol compound derived from formaldehyde, the amount of said methylol compound being about 0.7 to 30% by weight of said solution and being about 1 to 20 times the weight of the coloring agent, to the fibrous structure, heat-treating the fibrous structure at 100° to 220° C for 0.1 to 10 minutes and then treating the fibrous structure with a reducing agent selected from the group consisting of hydrogen, hydrogen iodide, hydrogen sulfide, lithium aluminum hydride, sodium borohydride, carbon monoxide, sulfur dioxide, thiourea dioxide, thiourea sulfite, sodium sulfide, polysodium sulfide, ammonium sulfide, alkali metals, magnesium, calcium, aluminum, zinc, iron (II) salts, tin (II) salts, titanium (III) salts, chromium (II) salts, aldehydes, saccharides, sodium bisulfite, Na-sulfoxylate formaldehyde, modified primary zinc salts of formaldehyde sulfoxylic acid and a hydrosulfite said reducing agents being used in an amount of 0.05 to 5% by weight based on the weight of the fibrous structure.

2. The process of claim 1, wherein said fibrous structure comprises cotton.

3. The process of claim 1, wherein said fibrous structure comprises a blend of polyethylene terephthalate fibers and fibers selected from the group consisting of cotton, viscose, flax and wool.

4. The process of claim 1, wherein the methylol compound and the coloring agent are applied to the fibrous structure in the same bath.

5. The process of claim 1, wherein the methylol compound is first applied to the fibrous structure, and then the coloring agent is applied to the fibrous structure.

6. The process of claim 5, wherein a catalyst for the methylol compound is included in a bath containing the coloring agent.

7. The process of claim 1, wherein the coloring agent is first applied to the fibrous structure, and then the methylol compound is applied to the fibrous structure.

8. The process of claim 1, wherein said heat-treating is at 130° C to 210° C for 0.3 to 5 minutes.

9. The process of claim 1, wherein said reducing agent is hydrosulfite or a formaldehyde-modified sulfoxylate.

10. The process of claim 1, wherein an alkali agent is jointly used in the treatment with the reducing agent.

11. The process of claim 1, wherein said amount of said reducing agent ranges from 0.1 to 3% by weight.

12. The process of claim 1, wherein said treating with said reducing agent comprises dipping said fibrous structure in a bath containing said reducing agent and then steaming said fibrous structure.

13. The process of claim 1, wherein said treating the fibrous structure with a reducing agent comprises dipping said fibrous structure in a bath containing said reducing agent for about 5 to 60 minutes and then heating said fibrous structure to a temperature of about 20° C to 130° C.

14. The process of claim 1, wherein said methylol compound derived from formaldehyde comprises precondensates of formaldehyde with compounds selected from the group consisting of phenol, cresols, aromatic amines, urea, alkylene ureas, hydroxyalkene ureas, carbamates, aminotriazines and triazones.

15. The process of claim 14, wherein said precondensate is a hydroxyalkene urea-formaldehyde precondensate or a triazone-formaldehyde precondensate.

16. The process of claim 1, wherein said fibrous structure comprises a blend of cotton and polyester fibers; wherein said coloring agent comprises a blend of a water-soluble reactive dye and a water-insoluble disperse dye; wherein said methylol compound derived from formaldehyde consists of a formaldehyde-hydroxyalkene urea precondensate compound; and wherein said reducing agent comprises a hydropersulfite or an aldehyde-modified sulfoxylate.

17. The process of claim 1, wherein said fibrous structure consists of cotton; wherein said coloring agent comprises a blend of a water-soluble reactive dye, a direct dye and an acid dye; wherein said methylol compound derived from formaldehyde consists of a formaldehyde-hydroxyalkylene urea precondensate compound; and wherein said reducing agent comprises a hydropersulfite or an aldehyde-modified sulfoxylate.

18. The process of claim 1, wherein said coloring agent is a disperse dye or a reactive dye.

19. A process for coloring a fibrous structure comprising a blend of polyethylene terephthalate fibers and fibers selected from the group consisting of cotton, viscose and flax which comprises applying (1) a coloring agent comprising a mixture of a disperse dye and a reactive or acid dye and (2) a hydroxyalkyleneurea-formaldehyde precondensate to said fibrous structure in a single bath, said precondensate being employed in an amount of about 0.7 to 30% by weight of said bath and being about 1 to 20 times the weight of said coloring agent; heat-treating said fibrous structure at a temperature of from about 130° to 210° C for a period of from about 0.3 to 5 minutes and treating the thus dyed fibrous structure at an alkaline pH with a reducing agent selected from the group consisting of hydrosulfite and a formaldehyde-modified sulfoxylate.

* * * * *